United States Patent [19]

Ware et al.

[11] 4,386,804

[45] Jun. 7, 1983

[54] CHAIR GANGING EQUIPMENT

[75] Inventors: Ronald D. Ware; Robert J. Bomber, both of Green Bay, Wis.

[73] Assignee: Krueger Metal Products, Inc., Green Bay, Wis.

[21] Appl. No.: 251,412

[22] Filed: Apr. 6, 1981

[51] Int. Cl.[3] ..... A47C 15/00

[52] U.S. Cl. ..... 297/248; 108/64; 297/239; 312/111

[58] Field of Search ..... 297/239, 248, 249; 108/64; 312/111

[56] References Cited

U.S. PATENT DOCUMENTS

| | | | |
|---|---|---|---|
| 1,127,488 | 2/1915 | Morris | 312/111 X |
| 2,952,300 | 9/1960 | Cohen | 297/239 |
| 2,956,618 | 10/1960 | Eames et al. | 297/248 |
| 3,025,105 | 3/1962 | Nash | 297/239 |
| 3,053,493 | 9/1962 | Stafford | 248/163 |
| 3,133,762 | 5/1964 | Newman | 297/239 |
| 3,159,425 | 12/1964 | Engstrom | 297/248 |
| 3,351,378 | 11/1967 | Bliss | 297/239 |
| 3,446,544 | 5/1969 | Serwer | 312/111 |
| 3,695,694 | 10/1972 | Mohr | 297/248 |
| 3,754,788 | 8/1973 | Martini | 297/445 |
| 3,826,453 | 7/1974 | Hitchcock | 297/248 |

FOREIGN PATENT DOCUMENTS

| | | | |
|---|---|---|---|
| 297762 | 11/1965 | Netherlands . | |
| 957583 | 5/1964 | United Kingdom . | |
| 979733 | 1/1965 | United Kingdom . | |
| 983926 | 2/1965 | United Kingdom | 297/248 |
| 1204613 | 9/1970 | United Kingdom | 297/248 |
| 1347843 | 2/1974 | United Kingdom . | |
| 1399461 | 7/1975 | United Kingdom | 297/248 |

*Primary Examiner*—James T. McCall

*Attorney, Agent, or Firm*—Henry C. Fuller

[57] ABSTRACT

Chairs with improved ganging equipment comprising a vertically disposed open-ended keyway on one side of each chair and an interfitting key on the other side of each chair to allow the chairs to be ganged by engaging the key of one chair in the keyway of adjacent chair. Any of the ganged chairs can be separated by lifting it out of engagement with the adjacent chairs.

5 Claims, 5 Drawing Figures

CHAIR GANGING EQUIPMENT

TECHNICAL FIELD

The present invention relates to chairs provided with ganging equipment to link them together in a row.

BACKGROUND ART

While chairs with ganging equipment are well known, ganging equipment typically has been of the hook and loop variety in which a hook on one chair engages a loop on the other to link them together. So that the chairs can be identical, each chair has a hook on one side and a loop on the other. If the hook opens downward, adjacent chairs can only be separated by raising the chair to which the hook is attached. If the hook opens upward, the two can only be separated by raising the chair to which the loop is attached. In either case one chair must be lifted away from the other, and not vice versa, to separate adjacent chairs. Since each chair has a loop one one side and a hook on the other, a chair in the middle of a ganged row of chairs cannot be removed. Rather, the chairs must be ganged or unganged in sequence.

Prior ganging devices in which the hook and loop linkage has been avoided, so that a central chair could be removed from a series of ganged chairs, have not prevented accidental disengagement of the chairs when one of the chairs is tilted or the floor supporting the chairs is uneven.

SUMMARY OF THE INVENTION

Improved ganging equipment for chairs comprises a vertically disposed open-ended keyway on one side of each chair and a projecting key mounted on the other side of each chair so the key of one chair can enter the keyway of the adjacent chair from above or below to interlock the chairs. The key or keyway can be vertically elongated so that one chair must be lifted substantially to separate it from the adjacent ganged chairs.

In a preferred embodiment of the invention the key and keyway are skeletonized and are defined by loops having interengaging bight portions. Also, the loops forming the key and keyway can be identical so the ganging devices can be assembled from identically formed rods.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
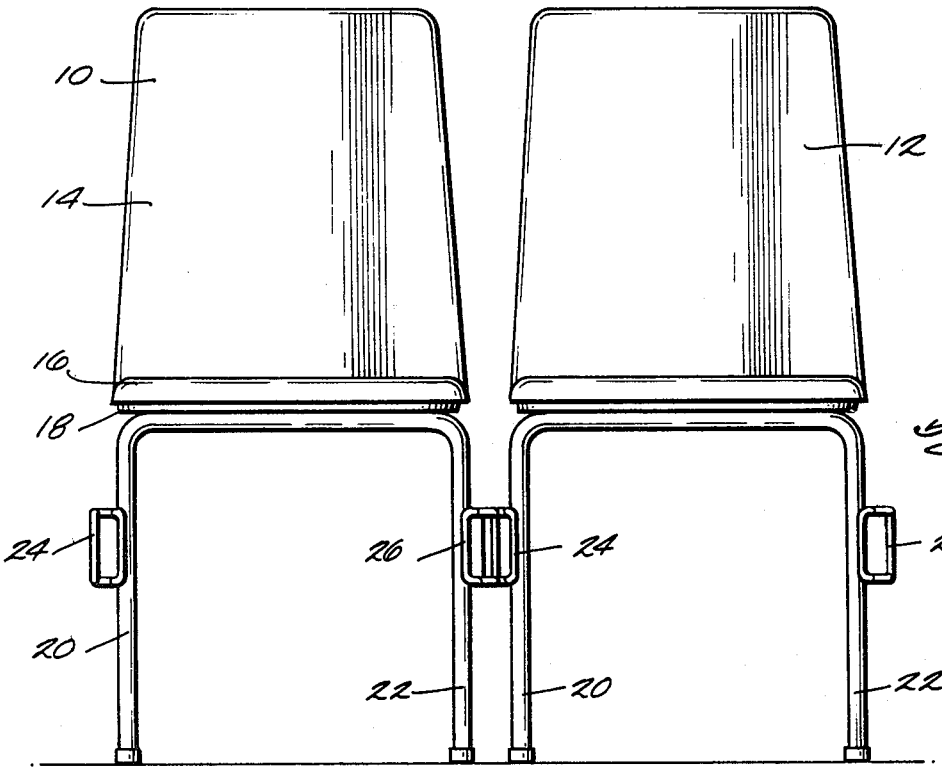
FIG. 1 is a front elevation of two ganged chairs provided with improved ganging equipment.

Referring first to FIG. 1, chairs 10 and 12 are identical, each comprising a back 14 and a seat 16 supported by a frame 18 including left and right pairs 20 and 22 of legs. Each chair includes ganging equipment comprising a key 24 mounted to each pair 20 of legs and a keyway 26 mounted to each pair 22 of legs. Thus, as shown in FIG. 1 each chair has a key mounted to its left side and a keyway mounted to its right side so each chair can be interlocked on either side with another to gang them together. Unlike chairs in which a hook engages a loop to gang them, either chair in FIG. 1 can be unganged by lifting it sufficiently to disengage the key and keyway, even if three or more chairs are ganged together and a chair in the middle of the ganged row is to be removed. The chairs can be assembled or disassembled in any order.

Figure 2:
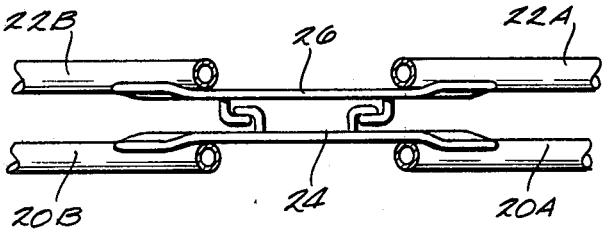
FIG. 2 is a fragmentary plan view of the ganging equipment joining the chairs of FIG. 1.

FIG. 2 shows why the chairs can be disengaged by lifting either one. Keyway 26, attached to front and rear legs 22A and 22B on one side of the chair, is a vertically disposed open-ended T-slot to allow key 24, mounted on legs 20A and 20B, to enter or leave keyway 26 from the top or bottom.

Figure 3:
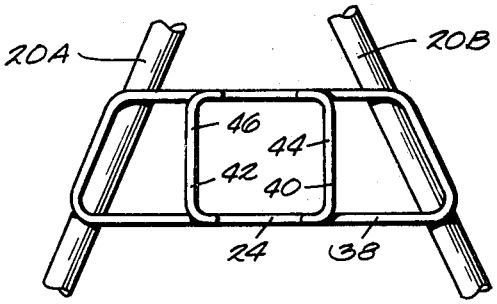
FIG. 3 is a fragmentary side elevation of FIG. 1, showing one element of the ganging equipment attached to the legs of one of the chairs.

FIG. 3 shows in more detail the attachment of the key or keyway, here key 24, to the paired front and rear legs such as 20A and 20B at one side of the chair.

Figure 4:
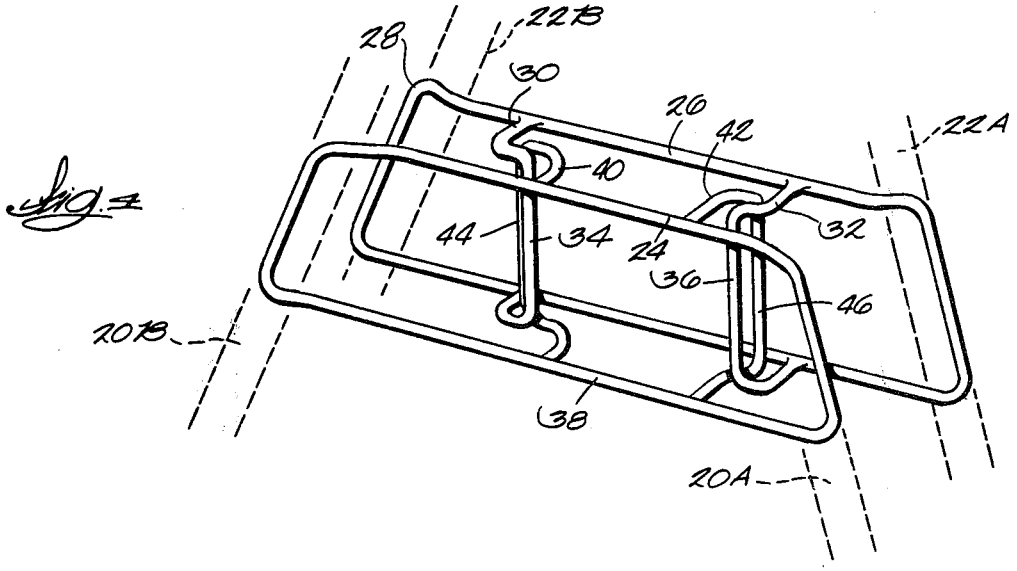
FIG. 4 is a perspective view of the ganging equipment of FIG. 1.
Figure 5:
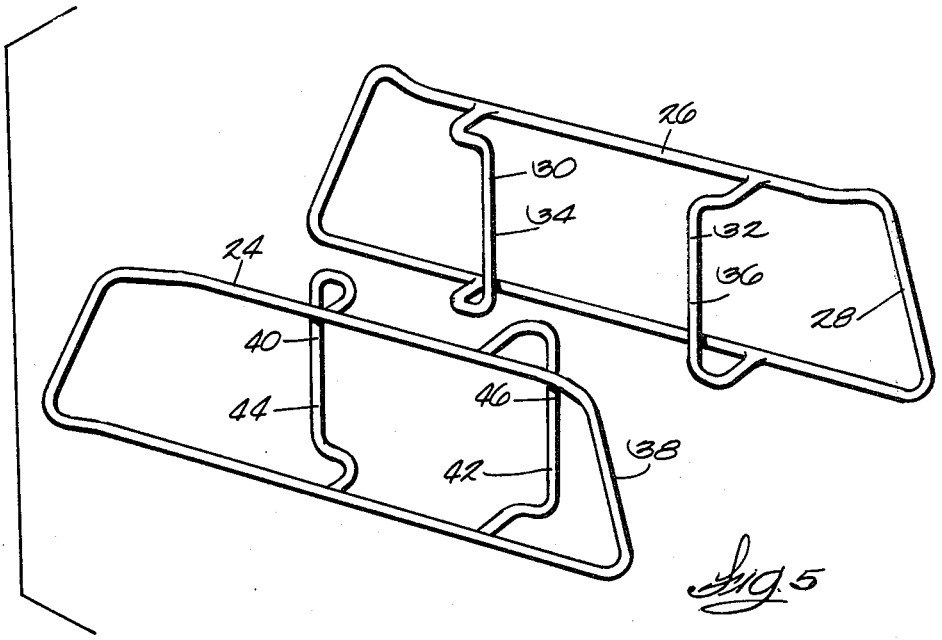
FIG. 5 is an exploded view of the ganging equipment of FIG. 4.

As shown in FIGS. 4 and 5, keyway 26 comprises first support means 28 for attachment to legs 22A and 22B and spaced loops 30 and 32 having inturned bight portions 34 and 36 in allochiral relation to define a T-slot.

Key 24 comprises second support means 38 supporting spaced loops 40 and 42 with outturned bight portions 44 and 46 in allochiral relation to form a slide which interfits within the inturned bight portions of keyway 26.

Loops 30 and 32 receive and respectively engage loops 40 and 42 to gang the chairs together. Even if the chairs stand on uneven ground, so that either the key or keyway is lifted somewhat above the other element, the chairs cannot become disengaged. Likewise, neither the key nor the keyway can be rotated substantially about any axis with respect to the other element when they are engaged. But if either chair is lifted sufficently to slide the key completely out of the keyway, the chairs then become separated.

Loops 30, 32, 40 and 42 are all identical, and first support means 28 and second support means 38 also are identical. Either key 24 or keyway 26 can be assembled by welding or otherwise attaching two loops to a support member. Also, the ganging equipment is skeletonized, reducing the amount of material needed to construct the equipment.

We claim:

1. In a chair construction including a seat, a frame including pairs of legs on each side for supporting the seat, and ganging means for connecting adjacent chairs in side-by-side relation, the improvement wherein the ganging means comprises:

a. keyway means connected to and projecting laterally from the frame and defining a vertically oriented open-ended slot, the keyway means comprising:

i. support means attached to one pair of legs; and ii. a pair of spaced loops connected to the support means, the loops having inturned bight portions in allochiral relation to define the slot; and b. key means connected to and projecting laterally from the frame on the opposite side of the chair from the keyway means, the key means comprising:

i. support means attached to the second pair of legs; and ii. a pair of spaced loops connected to the support means, the loops having outturned bight portions in allochiral relation to define a key, the key means adapted to interfit in the keyway means of a second chair, so that the interlocking key means and keyway means afford assembly and disassembly by lifting either the first or second chair, but which provide an interlock against lateral or rotational displacement of either one of the chairs when the key is assembled in the slot.

2. The improved ganging means of claim 1 wherein the keyway means defines a T-slot and the key means defines a T.

3. The improved ganging means of claim 2 wherein the keyway means T-slot and the key means T are skeletonized.

4. The improved ganging means of claim 3 wherein the loops of the key means and keyway means are interchangeable.

5. The improved ganging means of claim 4 wherein the vertical extent or the keyway means and key means are relatively large in relation to the vertical extent of the legs.

* * * * *